US007661160B1

(12) United States Patent
Adams

(10) Patent No.: US 7,661,160 B1
(45) Date of Patent: Feb. 16, 2010

(54) BEACH BLANKET

(76) Inventor: David M. Adams, 122 2nd St., Bonita Springs, FL (US) 34134

( * ) Notice: Subject to any disclaimer, the term of this patent is extended or adjusted under 35 U.S.C. 154(b) by 0 days.

(21) Appl. No.: 12/366,244

(22) Filed: Feb. 5, 2009

(51) Int. Cl.
*A47G 9/06* (2006.01)

(52) U.S. Cl. ..... 5/417; 5/485

(58) Field of Classification Search ..... 5/417, 5/419, 420, 482, 485, 486, 490, 502
See application file for complete search history.

(56) References Cited

U.S. PATENT DOCUMENTS

| | | | | |
|---|---|---|---|---|
| 1,624,797 | A * | 4/1927 | Morehouse | 5/417 |
| 3,862,876 | A * | 1/1975 | Graves | 428/83 |
| 4,709,430 | A | 12/1987 | Nicoll | |
| 4,951,333 | A * | 8/1990 | Kaiser et al. | 5/417 |
| 4,999,866 | A | 3/1991 | Lindsey | |
| 5,035,013 | A | 7/1991 | Bloom | |
| 5,056,172 | A | 10/1991 | Kaiser et al. | |
| 5,206,964 | A | 5/1993 | Wilson, Sr. | |
| D382,756 | S | 8/1997 | Ryan | |
| 6,073,283 | A | 6/2000 | Zheng | |
| 6,170,100 | B1 * | 1/2001 | Le Gette et al. | 5/417 |
| 6,343,391 | B1 * | 2/2002 | Le Gette et al. | 5/417 |
| 6,408,461 | B2 * | 6/2002 | Zheng | 5/417 |
| 6,463,605 | B2 | 10/2002 | Swagger, Jr. | |
| 6,485,344 | B2 | 11/2002 | Arias | |
| 6,519,793 | B2 * | 2/2003 | Le Gette et al. | 5/417 |
| 6,571,410 | B2 * | 6/2003 | Zheng | 5/417 |
| 6,634,040 | B2 * | 10/2003 | Le Gette et al. | 5/417 |
| 6,691,344 | B2 * | 2/2004 | Le Gette et al. | 5/417 |
| 6,915,537 | B2 * | 7/2005 | Le Gette et al. | 5/417 |
| 7,097,524 | B2 * | 8/2006 | Arias | 441/131 |
| 7,127,754 | B2 * | 10/2006 | Le Gette et al. | 5/417 |
| 7,134,930 | B2 * | 11/2006 | Arias | 441/131 |
| 7,147,528 | B2 * | 12/2006 | Arias | 441/131 |
| 7,243,384 | B2 * | 7/2007 | Le Gette et al. | 5/417 |
| 7,263,732 | B2 * | 9/2007 | Zheng | 5/417 |
| 7,335,080 | B2 * | 2/2008 | Arias | 441/131 |
| 7,490,378 | B2 * | 2/2009 | Le Gette et al. | 5/417 |
| 7,500,893 | B2 * | 3/2009 | Arias | 441/131 |
| 2003/0068940 | A1 * | 4/2003 | Arias | 441/131 |

* cited by examiner

*Primary Examiner*—Robert G Santos
(74) *Attorney, Agent, or Firm*—Crossley Patent Law; Mark A. Crossley

(57) ABSTRACT

A beach blanket that remains in an unfolded position while on a flat surface. The beach blanket has a pair of incorporated polyvinyl chloride (PVC) straps to provide internal, structural strength when the beach blanket is in an extended position. Also, the beach blanket has at least one internal wire loop that provides extra structural support when the beach blanket is open.

6 Claims, 8 Drawing Sheets

BEACH BLANKET

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved beach blanket that remains in an unfolded position while on a flat surface.

SUMMARY OF THE INVENTION

The present invention concerns that of a new and improved beach blanket that remains in an unfolded position while on a flat surface. The beach blanket has a pair of incorporated polyvinyl chloride (PVC) straps to provide internal, structural strength when the beach blanket is in an extended position. Also, the beach blanket has at least one internal wire loop that provides extra structural support when the beach blanket is open.

There has thus been outlined, rather broadly, the more important features of a beach blanket that the detailed description thereof that follows may be better understood and in order that the present contribution to the art may be better appreciated. There are, of course, additional features of the beach blanket that will be described hereinafter and which will form the subject matter of the claims appended hereto.

In this respect, before explaining at least one embodiment of the beach blanket in detail, it is to be understood that the beach blanket is not limited in its application to the details of construction and to the arrangements of the components set forth in the following description or illustrated in the drawings. The beach blanket is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present beach blanket. It is important, therefore, that the claims be regarded as including such equivalent constructions insofar as they do not depart from the spirit and scope of the present invention.

It is therefore an object of the present invention to provide a beach blanket which has all of the advantages of the prior art and none of the disadvantages.

It is another object of the present invention to provide a beach blanket which may be easily and efficiently manufactured and marketed.

It is another object of the present invention to provide a beach blanket which is of durable and reliable construction.

It is yet another object of the present invention to provide a beach blanket which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
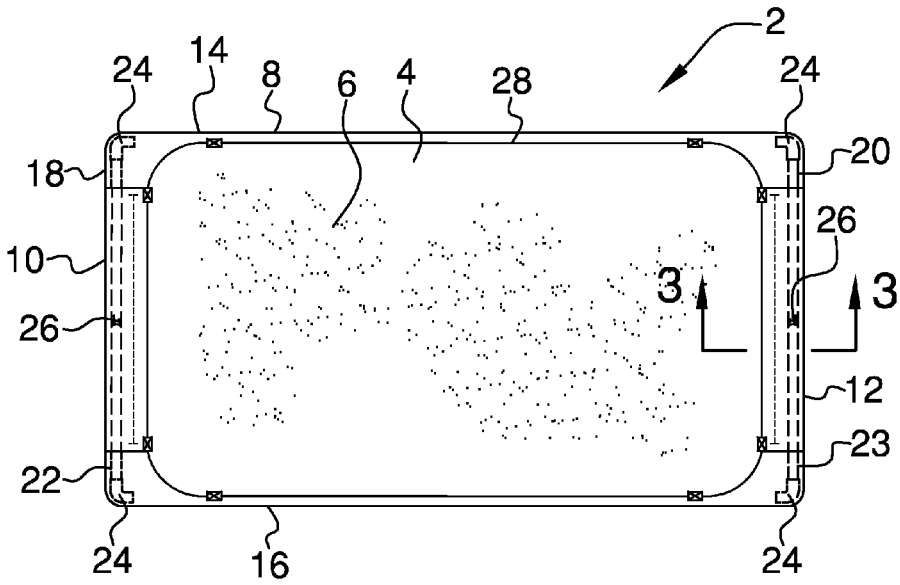
FIG. 1 shows a top view of the beach blanket as it would appear in use.
Figure 3:
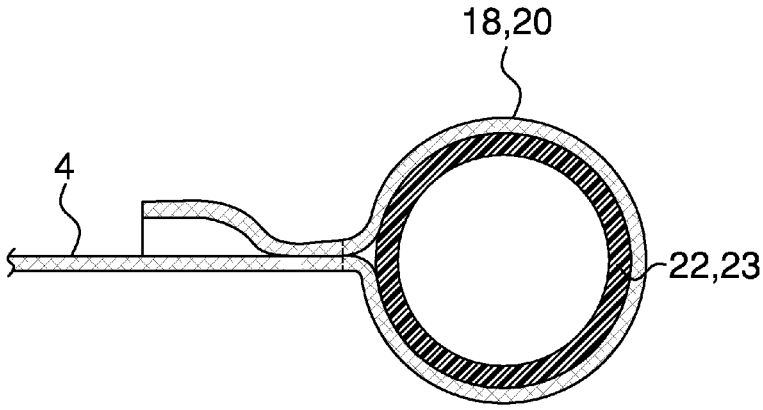
FIG. 3 shows a cross-sectional view of one of the PVC pipes that are incorporated into the beach blanket.
Figure 2:
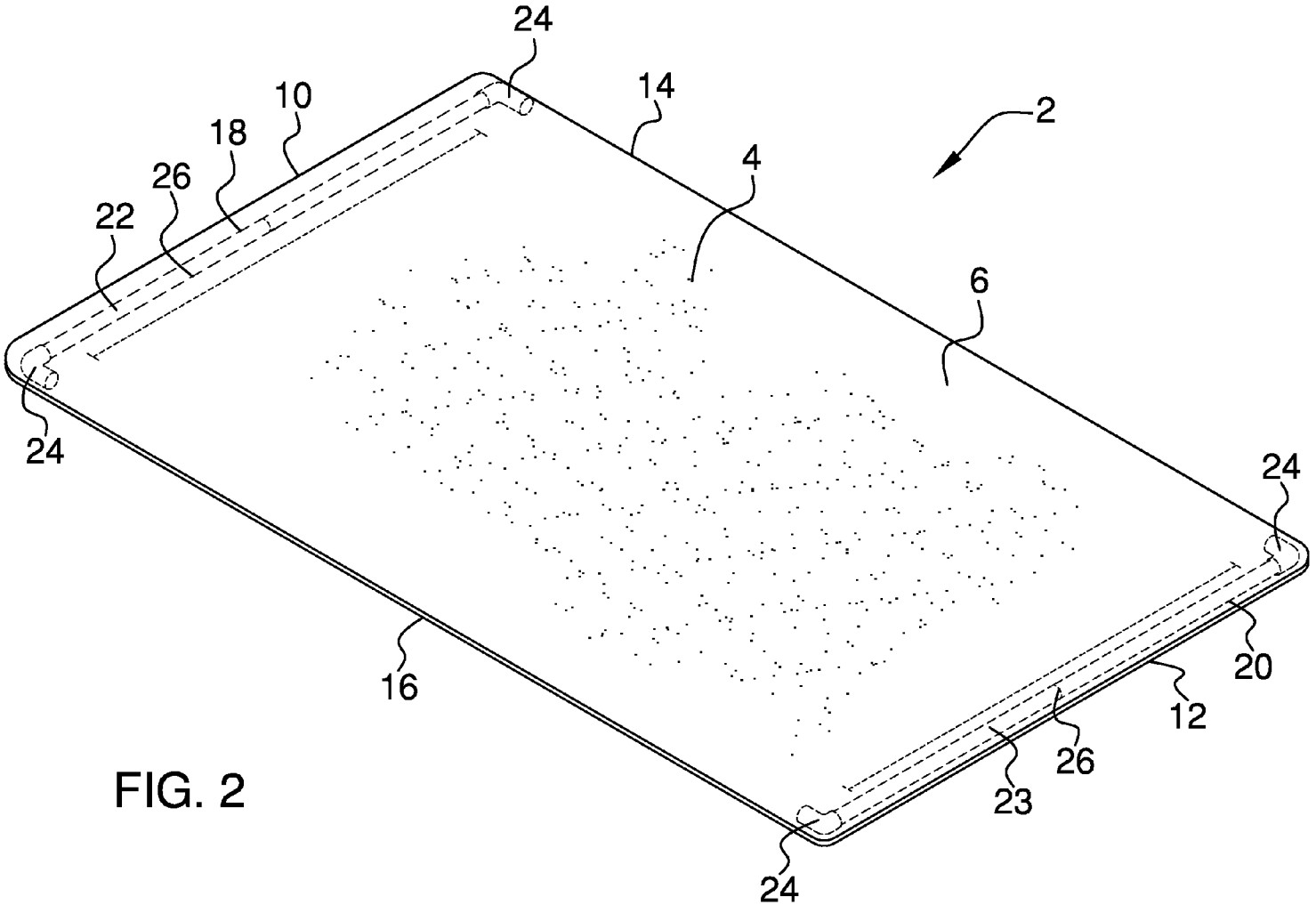
FIG. 2 shows a top perspective view of the beach blanket as it would appear in use.
Figure 4:
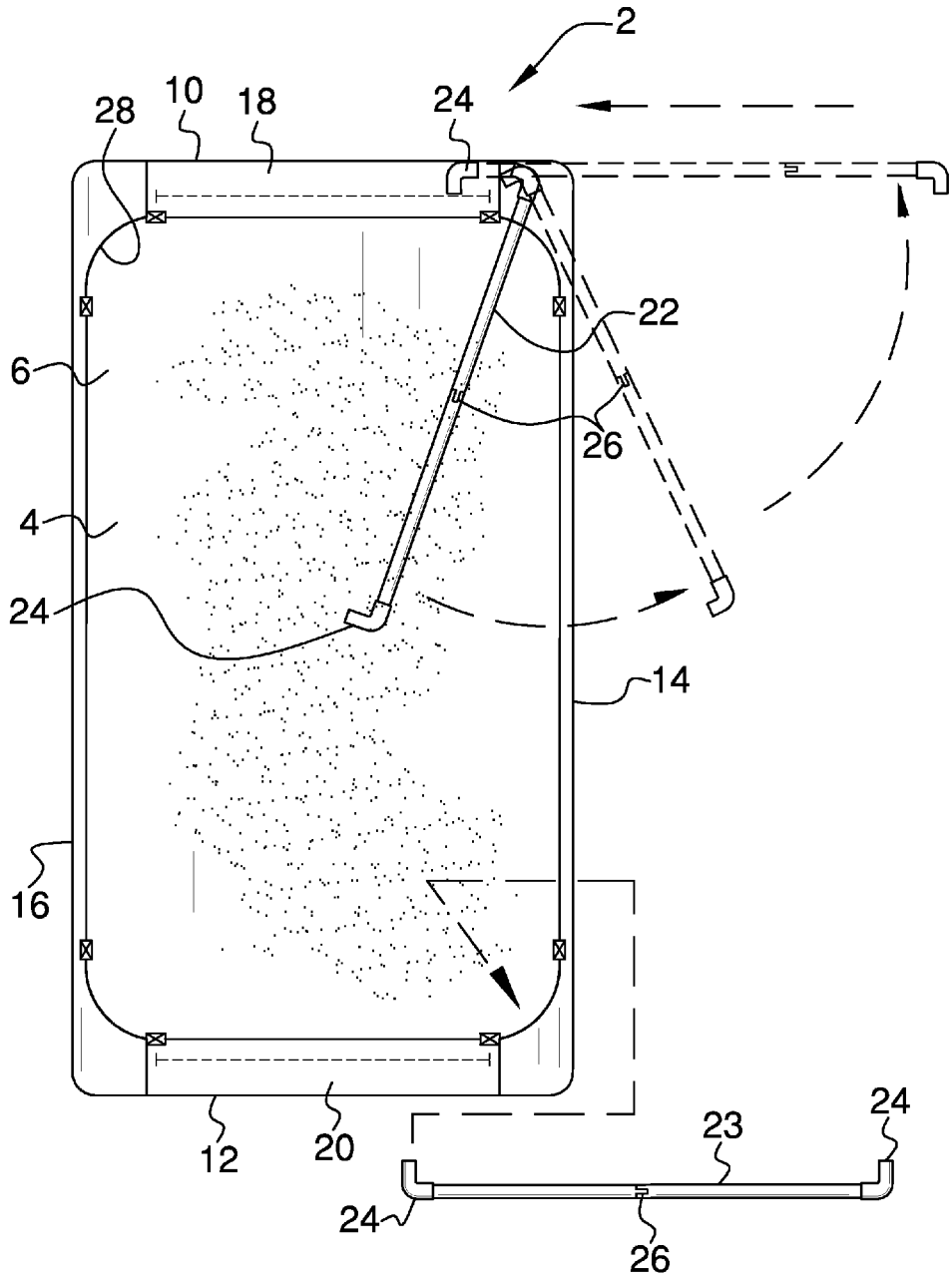
FIG. 4 shows a top view of the beach blanket as it would appear while the PVC pipes are being inserted into the ends of the beach blanket.
Figure 5:
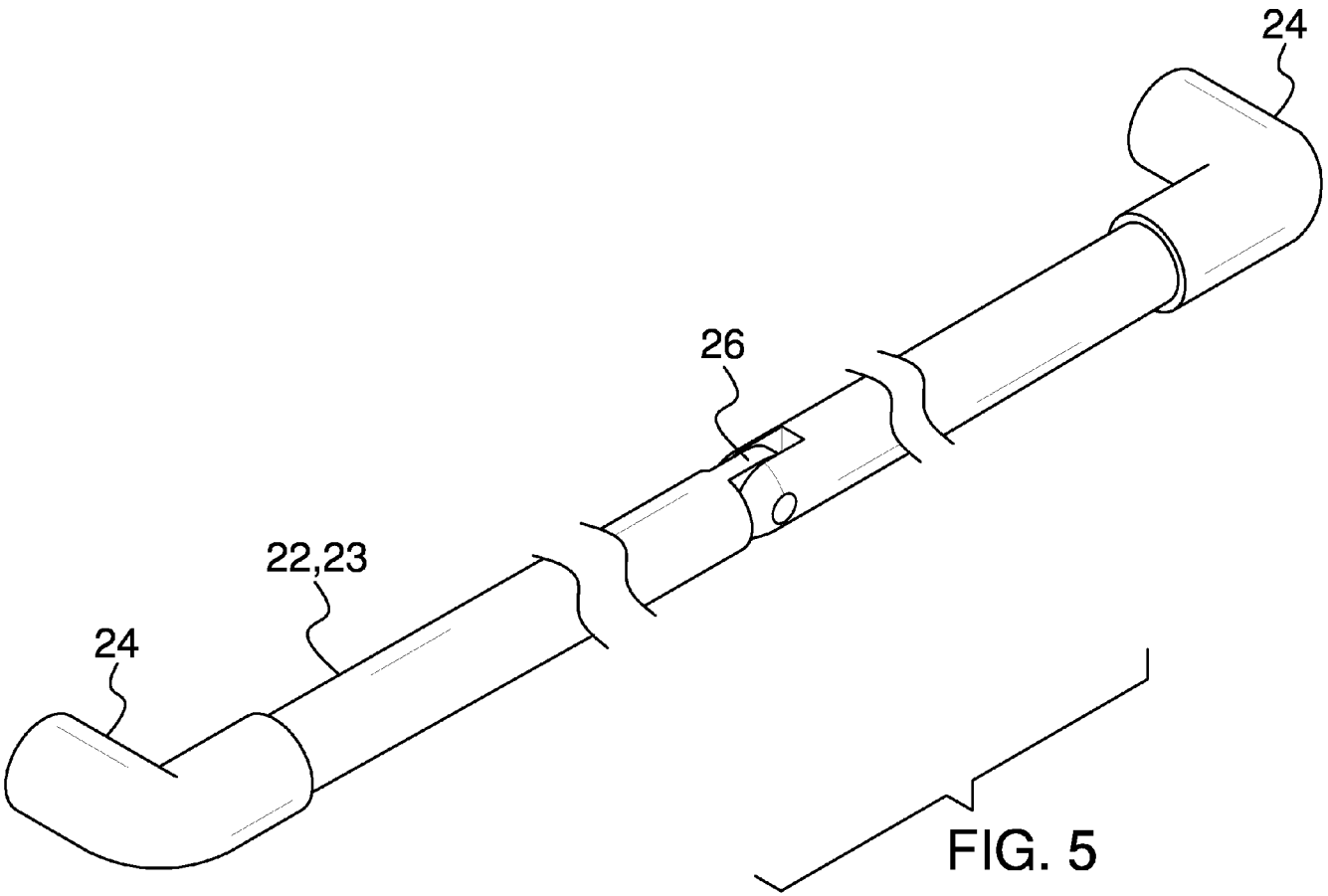
FIG. 5 shows a perspective view of one of the PVC pipes that are incorporated into the beach blanket.
Figure 6:
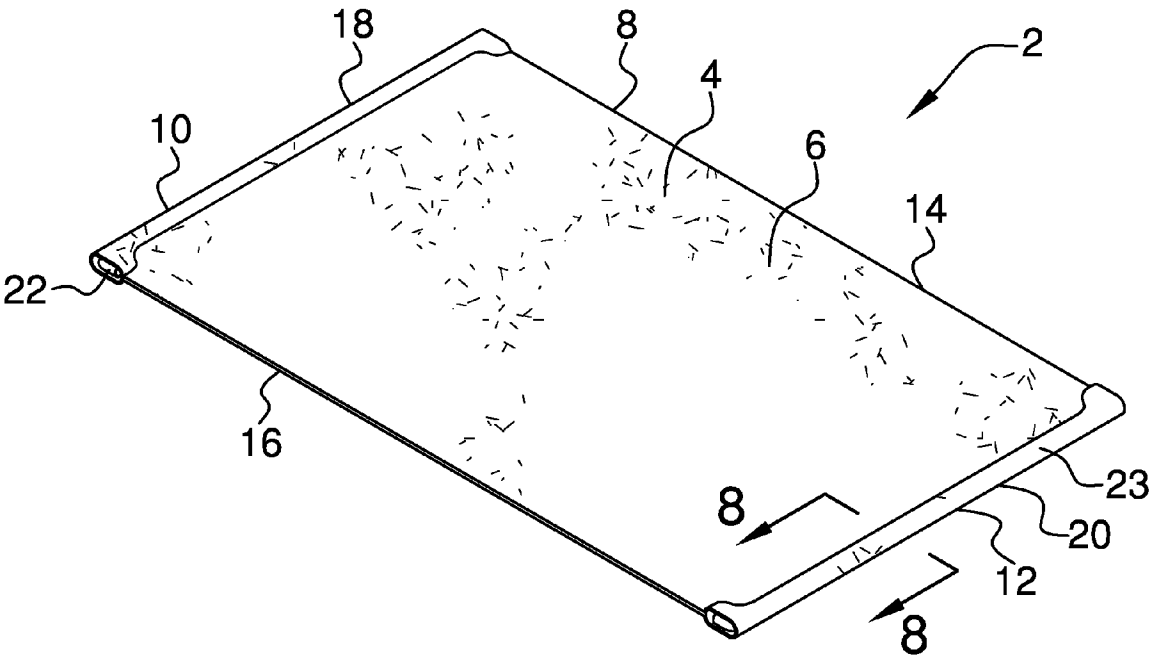
FIG. 6 shows a top perspective view of the beach blanket as it would appear in use.
Figure 8:
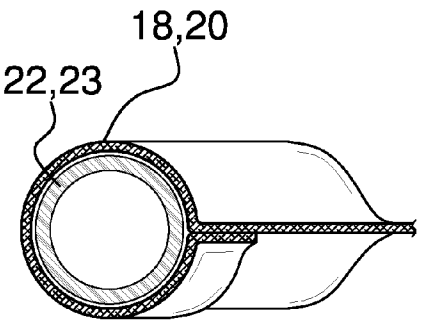
FIG. 8 shows a perspective cross-sectional view of one of the PVC pipes that are incorporated into the beach blanket.
Figure 7:
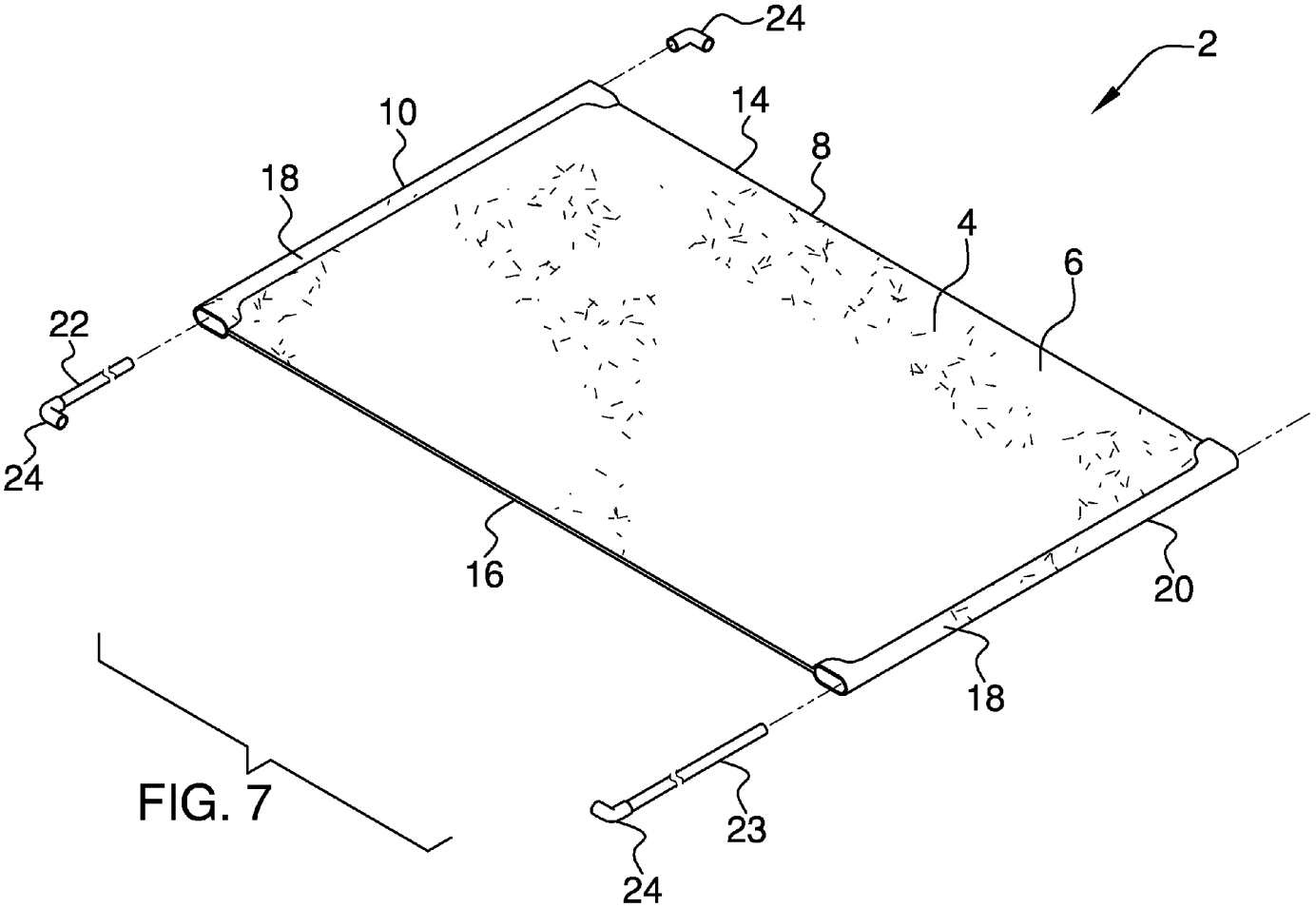
FIG. 7 shows a top perspective view of the beach blanket as it is seen with the PVC pipes being installed into the ends of the beach blanket.
Figure 9:
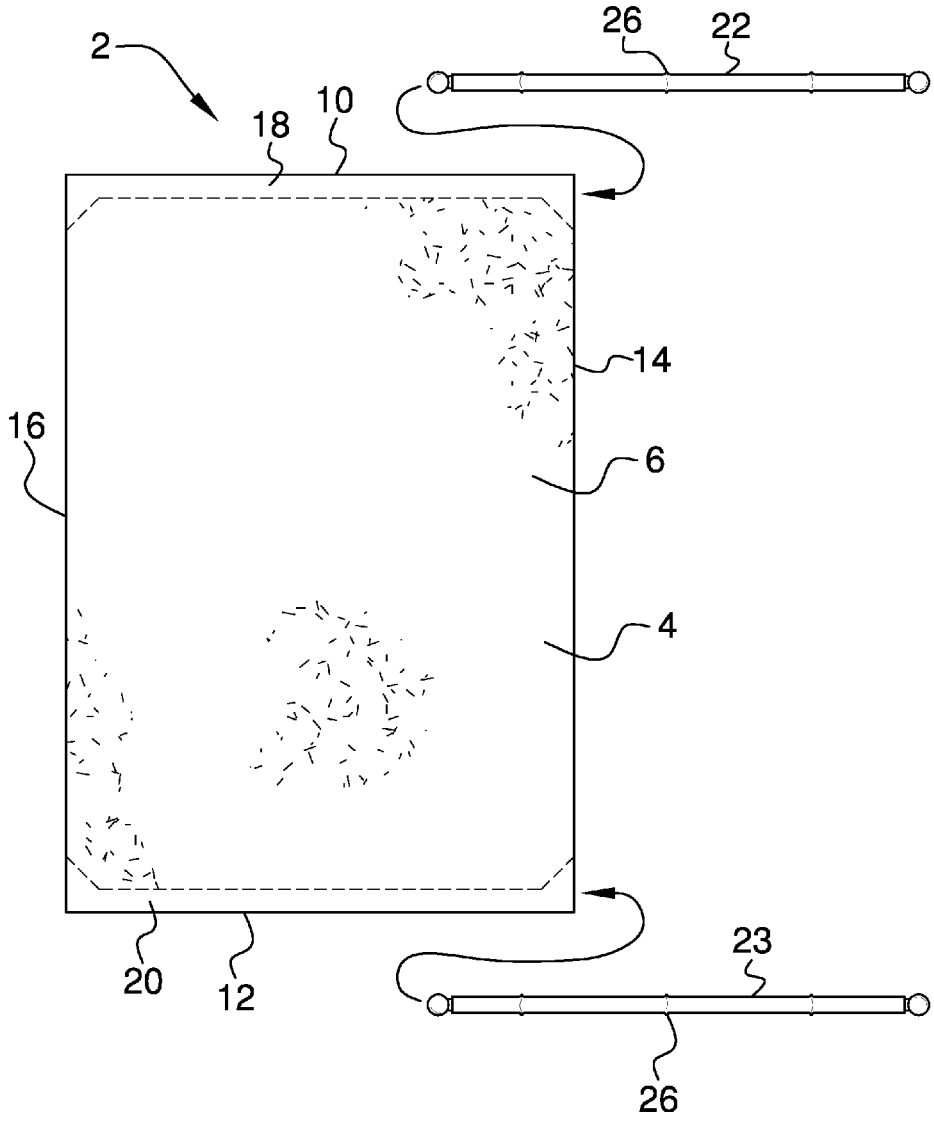
FIG. 9 shows a top view of the beach blanket as it would appear while the PVC pipes are being inserted into the ends of the beach blanket.
Figure 10:
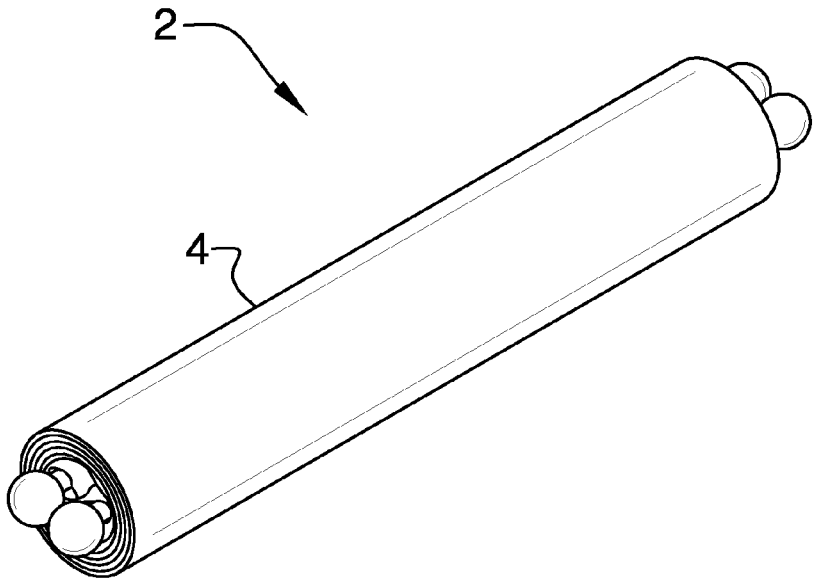
FIG. 10 shows a perspective view of the beach blanket as it would appear rolled up.

With reference now to the drawings, and in particular to FIGS. 1 through 10 thereof, a beach blanket embodying the principles and concepts of the present invention and generally designated by the reference numeral 2 will be described.

As best illustrated in FIGS. 1 through 10, the beach blanket 2 comprises a blanket 4 that has a pair of surfaces comprising an upper surface 6 and a lower surface 8, and furthermore, comprises two ends comprising a first end 10 and a second end 12. The blanket 4 also comprises two side surfaces comprising a first side surface 14 and a second side surface 16.

The first end 10 of the blanket 4 has a first sleeve 18, while the second end 12 of the blanket 4 has a second sleeve 20. Each of the sleeves runs from the first side surface 14 to the second side surface 16. Once the blanket 4 has been unfolded and fully laid flat, pipes 22, 23 are inserted into the sleeves 18, 20, respectively. The pipes 22, 23 can be manufactured from a wide variety of substances but preferably are manufactured from polyvinyl chloride, which is known by a commonly-used phrase "PVC." PVC functions essentially as a hard plastic substance when being used.

Each of the pipes 22, 23 has two ends comprising a first end and a second end. When the blanket 4 of the beach blanket 2 is being used, an elbow joint 24 can be attached to each end of pipes 22, 23, thereby ensuring that the pipes 22, 23 will more likely stay within the sleeves 18, 20.

Each of the pipes 22, 23 has a centrally located joint 26, allowing each of the pipes 22, 23 to be folded as needed. The presence of this joint 26 will allow the each pipe to independently be folded up as needed.

The beach blanket 2 also has at least one internal wire loop 28 that is incorporated into the blanket 4. The loop 28 essentially forms a rough, concentric circle and like the pipes 22, 23, serves as a skeletal support structure for the blanket 4 once it has been unfolded.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A beach blanket comprising:

a blanket, the blanket having two surfaces comprising an upper surface and a lower surface, the blanket also having two ends comprising a first end and a second end, the blanket also having two side surfaces comprising a first side surface and a second side surface, means for providing a structural framework within the blanket to help keep it in an open position once the blanket has been opened, wherein the means for providing a structural framework within the blanket to help keep it in an open position once the blanket has been opened further comprises a pair of sleeves comprising a first sleeve and a second sleeve, wherein the first sleeve is located on the first end of the blanket, further wherein the second sleeve is located on the second end of the blanket, wherein each of the sleeves runs from the first side surface of the blanket to the second side surface of the blanket, a pair of objects comprising a first object and a second object, wherein each object is inserted into a sleeve after the blanket has been opened, wherein the pair of objects further comprises a pair of pipes comprising a first pipe and a second pipe, wherein each pipe has two ends comprising a first end and a second end, wherein the first pipe is inserted into the first sleeve after the blanket has been opened, and further wherein the second pipe is inserted into the second sleeve after the blanket has been opened.

2. A beach blanket according to claim 1 wherein the beach blanket further comprises (a) a plurality of elbow joints, (b) wherein an elbow joint is attached to each end of each pipe after each pipe has been inserted into a sleeve on the blanket.

3. A beach blanket according to claim 2 wherein the beach blanket further comprises (a) at least one internal wire loop, (b) wherein the internal wire loop is incorporated into the blanket.

4. A beach blanket according to claim 3 wherein each pipe further comprises (a) a joint, (b) wherein the joint is preferably centrally-located on the pipe.

5. A beach blanket according to claim 4 wherein each pipe is preferably manufactured from polyvinyl chloride (PVC).

6. A beach blanket comprising (a) a blanket, the blanket having two surfaces comprising an upper surface and a lower surface, the blanket also having two ends comprising a first end and a second end, the blanket also having two side surfaces comprising a first side surface and a second side surface, and (b) means for providing a structural framework within the blanket to help keep it in an open position once the blanket has been opened, said means further comprising (i) a pair of sleeves comprising a first sleeve and a second sleeve, wherein the first sleeve is located on the first end of the blanket, further wherein the second sleeve is located on the second end of the blanket, wherein each of the sleeves runs from the first side surface of the blanket to the second side surface of the blanket, (ii) a pair of objects comprising a first object and a second object, wherein each object is inserted into a sleeve after the blanket has been opened, (iii) wherein the pair of objects further comprises a pair of pipes manufactured from a rigid material comprising a first pipe and a second pipe, wherein each pipe has two ends comprising a first end and a second end, wherein the first pipe is inserted into the first sleeve after the blanket has been opened, and further wherein the second pipe is inserted into the second sleeve after the blanket has been opened, wherein each pipe further comprises (i) a joint, (ii) wherein the joint is preferably centrally-located on the pipe, (c) a plurality of elbow joints, wherein an elbow joint is attached to each end of each pipe after each pipe has been inserted into a sleeve on the blanket, (d) at least one internal wire loop, wherein the internal wire loop is incorporated into the blanket, (e) wherein each pipe is preferably manufactured from polyvinyl chloride (PVC).

* * * * *